United States Patent [19]

Westeren et al.

[11] 4,103,880

[45] Aug. 1, 1978

[54] APPARATUS FOR HEAT TREATING DRILL BLANKS

[75] Inventors: Herbert W. Westeren, Barrington, R.I.; Richard P. McCally, N. Attleboro, Mass.

[73] Assignee: C. I. Hayes Inc., Cranston, R.I.

[21] Appl. No.: 723,704

[22] Filed: Sep. 16, 1976

[51] Int. Cl.[2] ..... C21D 1/12

[52] U.S. Cl. ..... 266/253; 148/153; 148/155; 266/260

[58] Field of Search ..... 148/153, 155; 214/1 BB, 214/1 BD, 8.5 F, 18 R, 147 T; 266/124, 134, 253, 258, 260; 432/10, 122, 123, 124, 226, 239

[56] References Cited

U.S. PATENT DOCUMENTS

| | | | |
|---|---|---|---|
| 1,337,465 | 4/1920 | Olson | 266/260 |
| 1,418,985 | 6/1922 | Stock | 266/260 X |
| 1,824,121 | 9/1931 | Charlton | 432/123 |
| 1,865,831 | 7/1932 | Cave | 214/8.5 F X |
| 2,551,199 | 5/1951 | Bašus | 214/8.5 F X |
| 2,974,941 | 3/1961 | Hobdell | 266/260 X |
| 3,764,023 | 10/1973 | Jatcko | 214/147 T X |

FOREIGN PATENT DOCUMENTS

| | | | |
|---|---|---|---|
| 665,573 | 9/1938 | Fed. Rep. of Germany | 214/8.5 F |

*Primary Examiner*—Roy Lake
*Assistant Examiner*—Paul A. Bell
*Attorney, Agent, or Firm*—Salter & Michaelson

[57] ABSTRACT

Apparatus for automatically heat treating a plurality of elongated articles, wherein only a portion of the articles are subjected to the heat treating operation, the remaining portion thereof being enveloped and prevented from reaching a temperature during the heat treating operation that produces a hardening action thereon. The articles are transferred from a magazine assembly to a pick-up station, wherein the portions thereof that are protected from the heat treating operation are clamped between a jaw assembly, the jaw assembly being elevated to locate the exposed portion of the articles in vertical position within an elevated heating chamber. Thereafter the articles are lowered from the heating chamber to a cooling station and after a predetermined cooling period are deposited on a belt by the jaw assembly for removal to a collection station.

21 Claims, 18 Drawing Figures

APPARATUS FOR HEAT TREATING DRILL BLANKS

BACKGROUND OF THE INVENTION

The present invention has particular application in the heat treating of drill blanks, wherein the shank portion of the drill blank must be marked with identifying indicia, such as the size thereof and the name of the manufacturer. Prior to the instant invention, special processes were utilized in the heat treatment of drill blanks in order to maintain the shank of the blank in soft enough conditon not only to imprint the identifying indicia or lettering thereon, but also to enable a drill chuck to effect a suitable gripping action thereon in use of the drill. The convenitonal technique in heat treating drill blanks was in the use of a furnace that employed a salt bath for hardening the fluted portions of the blanks, the shanks of the drills usually being held in insulated grip tongs while the flutes were lowered into the hot salt. After the heat treatment, the flutes were quenched in air or in a lower temperature salt or in oil. After the quenching operation a cleaning procedure such as sand blasting was necessary for the cleaning before tempering and marking of the drill shanks.

The salt bath process has been found objectionable because of the high costs of power involved in maintaining the salt in proper condition for heat treating, and usually the salt bath must be maintained in continuous operation even when the heat treating operation is not being carried out, since it is not economically feasible to cut off the power to the salt bath unit. This technique has also been found to violate certain government regulations now in practice.

Other techniques for heat treating drill blanks have also been used that included a salt bath that heat treated the blanks throughout the length thereof. After the heat treatment operation and the cooling of the blanks, they were subject to a second treatment for softening the shanks. This treatment usually consisted of fixing the blanks in tongs and then lowering the shanks thereof into hot lead or salt. Thereafter a cleaning procedure was also necessary before further processing.

Some prior processes have avoided the use of the salt bath and have employed an atmosphere controlled furnace, the drill blanks being loaded in trays or baskets and then placed in the furnace for the heat treatment thereof. After the heat treatment operation and the passage of the work load into a cooling chamber, the drill blanks were file-hard all over. Although the drill blanks were clean after this heat treatment procedure, they still have to be processed further to soften the shanks which caused discoloration of the shanks and also necessitated a separate cleaning step.

Another method and apparatus for heat treating drill blanks whereby the shanks of the drill blanks were protected during the heat treating operation is disclosed in U.S. Pat. No. 3,704,871; and, although the process as disclosed in this patent protected the shanks by means of a ceramic fiber work holder and achieved the desired result without the use of the salt bath or the other time consuming techniques set forth hereinabove, the process was carried out on a batch basis and was not automatic.

Although all of the prior known procedures accomplish the purpose of enabling the drill shank to be marked with appropriate identifying indicia and to be sufficiently soft for gripping by a chuck, the additional steps involved and the fact that none of the prior procedures was performed on an automatic basis, necessarily increased the cost of manufacture of the drill blanks and further caused considerable delays in obtaining the finished product.

SUMMARY OF THE INVENTION

The present invention provides for the continuous heat treatment of metallic articles such as drill blanks in a unique furnace construction, wherein the shank portions of the drill blanks are sufficiently protected so that during the heat treating operation they do not reach that temperature that results in a relatively hard surface. The blanks are automatically fed from a magazine to a pick-up station where they are received between the jaws of a jaw assembly. The jaw assembly is operated in timed relation to move the drill blanks transferred thereto in an upward direction for elevation into an elevated heating chamber. Following a prescribed heat treating operation, the jaw assembly with the drill blanks clamped therein are lowered to a cooling station at which the exposed portions of the blanks that have been heat treated are subject to contact by cooling blocks. Thereafter, the blanks are lowered by the jaw assembly to a transfer belt located at the pick-up station for movement to a collection station and further processing.

During the entire heat treating and cooling operations, the shank portions of the drill blanks are protected by the jaws of the jaw assembly and are prevented from reaching the temperatures to which the fluted portion of the blanks are subjected. The process is continuous in that simultaneously with the deposit of the heat treated blanks on the transfer belt for movement to the collection station, a plurality of unprocessed blanks are moved to the pick-up station between the jaws of the jaw assembly for transfer to the heat treating chamber as previously described. As soon as the magazine is filled with the blanks and the furnace is placed in operation, the entire process is automatic and the blanks are continuously heat treated, cooled and transferred to the collection station.

Accordingly, it is an object of the present invention to provide apparatus for heat treating metallic articles, wherein a portion of the articles is insulated during the heat treating operation so as to be prevented from becoming overly hardened, the entire heat treating operation being automatic and continuous.

Other objects, features, and advantages of the invention will become apparent when the description thereof proceeds when considered in connection to accompanying illustrative drawings.

DESCRIPTION OF THE DRAWINGS

In the drawings which illustrate the best mode presently contemplated for carrying out the present invention.

DESCRIPTION OF THE INVENTION

Figure 1:
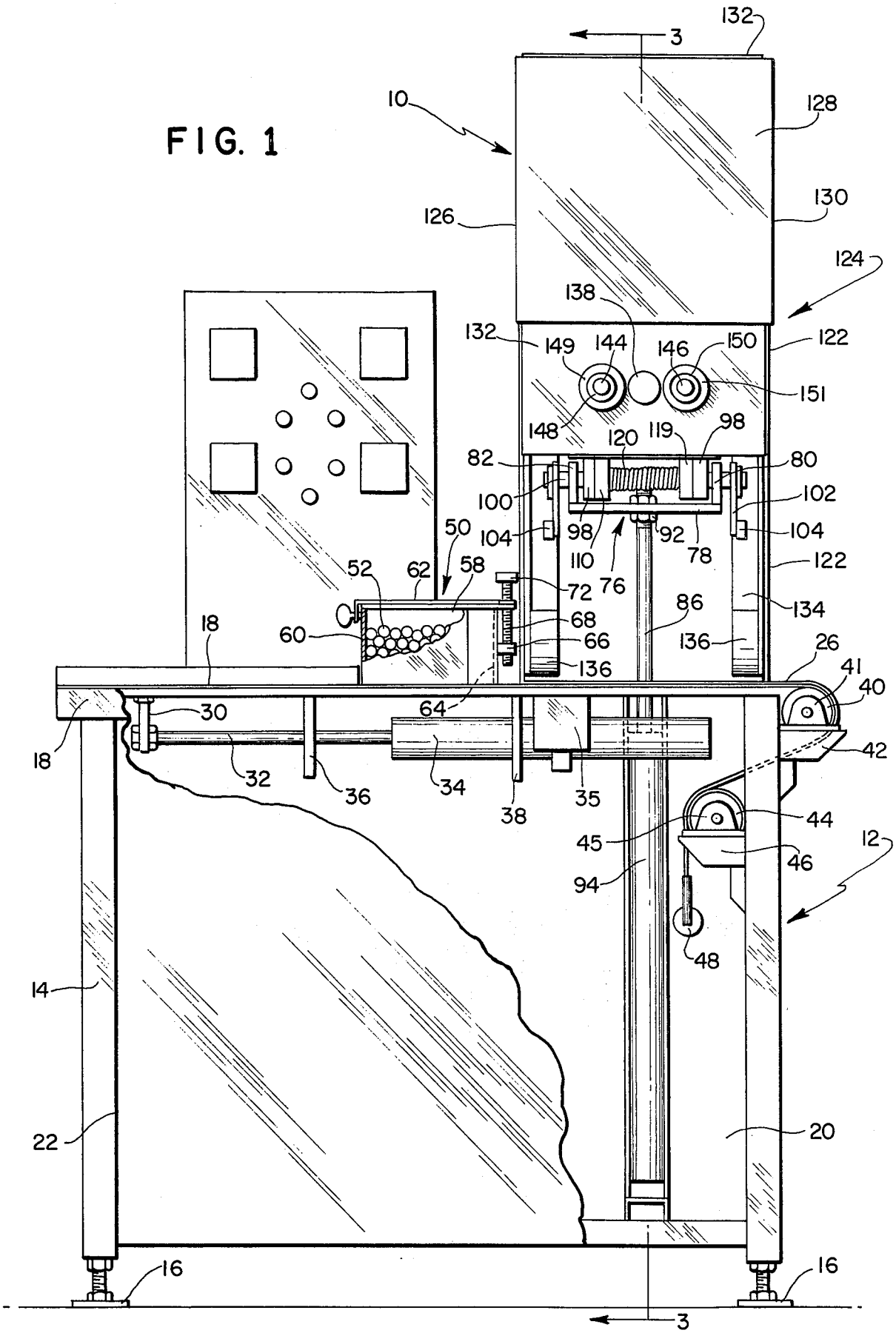
FIG. 1 is a front elevational view with parts shown in section of the apparatus embodied in the present invention, and with a portion of the front wall of the base broken away to illustrate the interior thereof.
Figure 2:
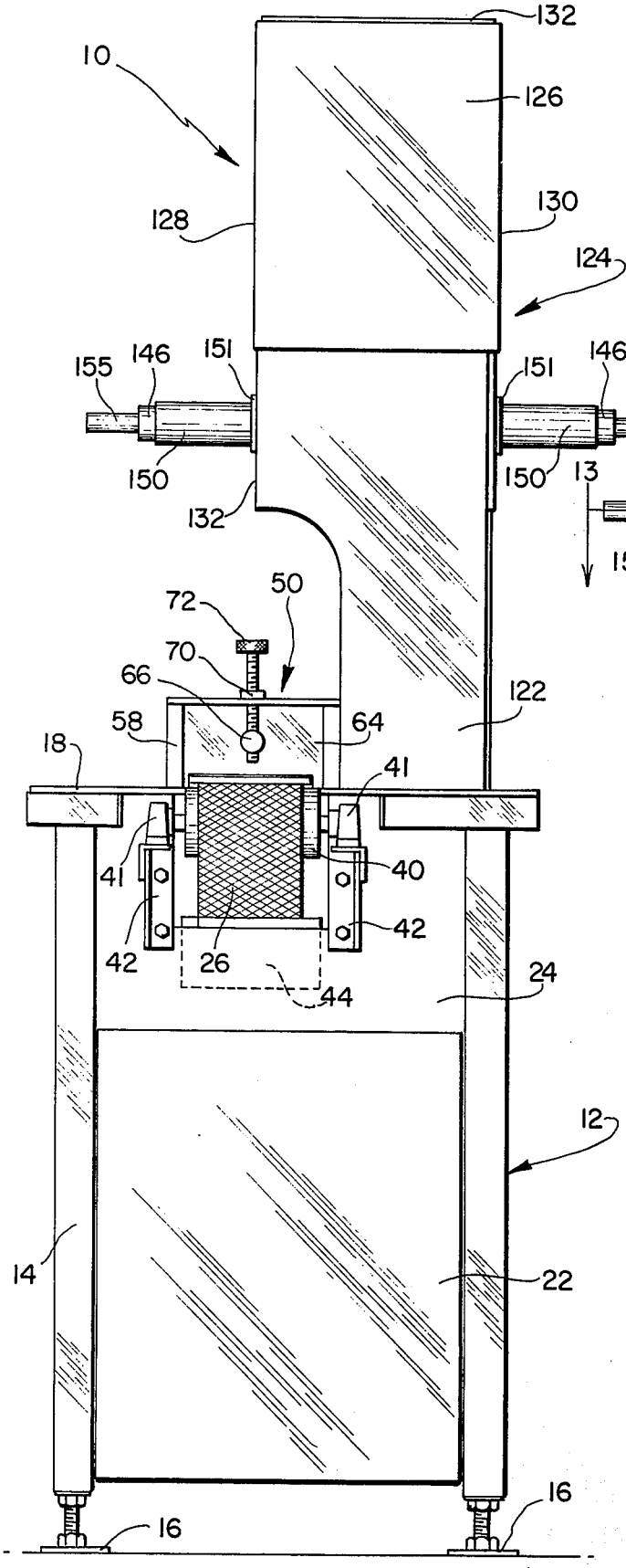
FIG. 2 is a side elevational view thereof.
Figure 3:
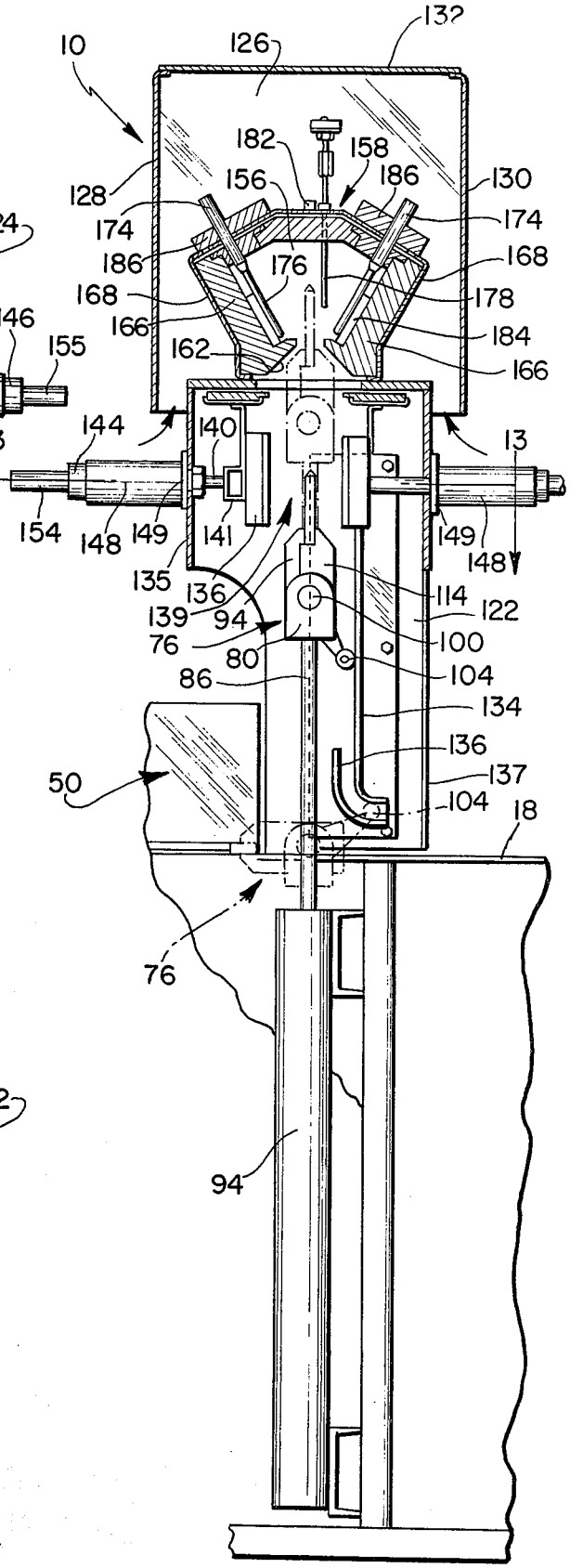
FIG. 3 is a sectional view taken along line 3—3 in FIG. 1.
Figure 4:
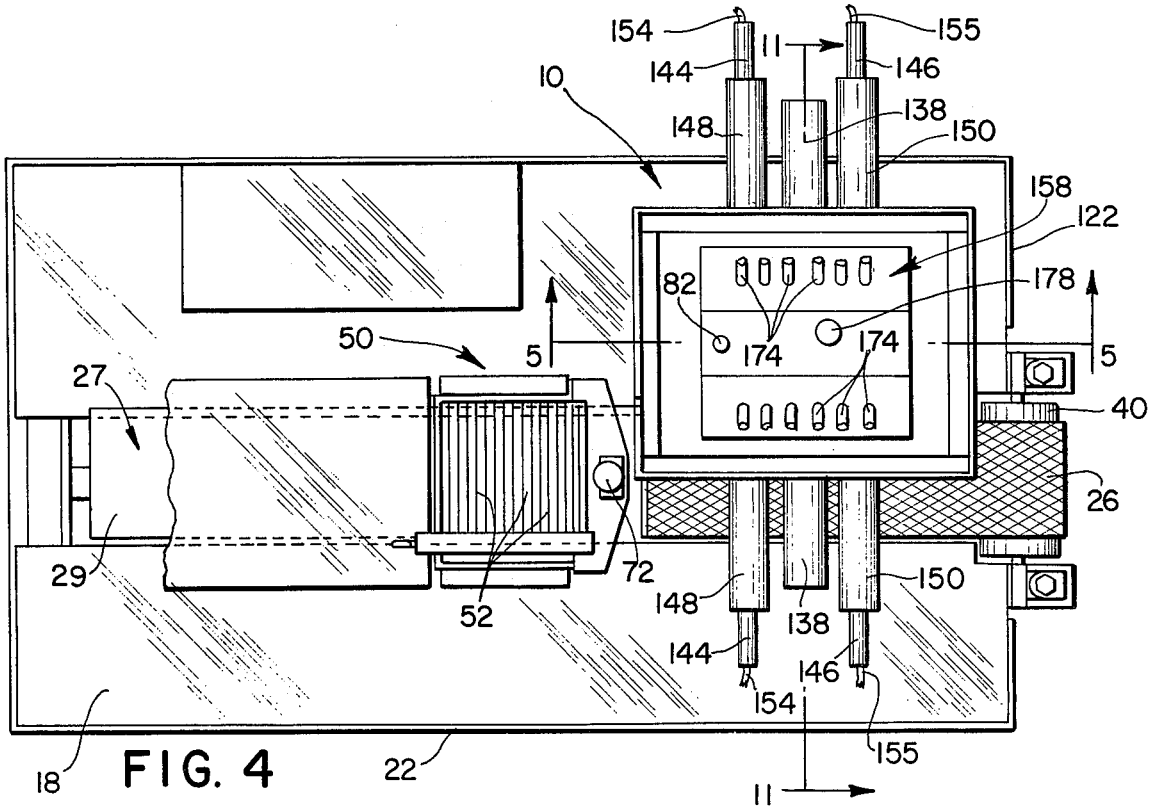
FIG. 4 is a top plan view of the apparatus.

Referring now to the drawings, and particularly to FIGS. 1–3, the apparatus for heat treating drill blanks is illustrated and is generally indicated at 10. As will be described, the apparatus 10 has specific application for heat treating drill blanks so that the shank portion of the blanks is protected and insulated during the heat treating and cooling operations. By insulating and cooling the shank portions of the blanks during the heat treating operation, the fluted portions thereof are subject to the appropriate heating and cooling temperatures for obtaining a relatively hardened casing thereon, while preventing the shank portion from reaching the austenitizing temperature. Thus, the shank portions of the drill blanks are only partially heated to the austenitizing temperature and will remain in a relatively soft condition for eventual marking thereon for identification by a conventional stamping procedure. The relatively soft shanks further enable the drills to be properly gripped in a drill chuck during the commercial use thereof; and, as described herein, the drill blanks include the fluted portions that are heat treated. In practice the blanks may be processed by the apparatus described herein without the formation of the fluted portions, the fluted portions being later formed by milling and after the heat treating operation. Although, as described above, the purpose of the apparatus described herein is for heat treating drill blanks, it is understood that other elongated articles may be heat treated by the apparatus in the manner as described, without departing from the spirit of the invention.

The apparatus 10 includes a base generally indicated at 12, having a plurality of vertical standards 14 located at the ends thereof, adjustable pedestals 16 being mounted in the lowermost ends of the standards 14 for engagement with the floor on which the apparatus is positioned. Mounted on the uppermost end of the base 12 and spanning the standards 14 are spaced top portions 18 that define the top of the base and between which a magazine and drill transfer mechanism is located, as will be described. Enclosing the base 12 is a rear wall 20, a front wall 22 and side walls 24. Mounted on the uppermost end of the base 12 and extending between the top portions 18 is a transfer assembly comprising a wire mesh belt 26 that extends for a portion of the length of the base 12 and terminating interiorly thereof as shown in FIG. 1.

The rearmost end of the belt 26 is fixed to a transfer plate generally indicated at 27, that is defined by overlapping plates 28 and 29 (FIG. 9), the transfer plate 27 being mounted for reciprocal movement on the upper end of the base 12 and having a rod 30 joined to the underside thereof (FIG. 1).

Fixed to the rod 30 and interconnected to the transfer plate 27 is a piston rod 32 that is formed as part of a penumatically operated cylinder 34, the cylinder 34 being secured within the base 12 to the top portions 18 by spaced brackets 35. Support plates 36 and 38 are located on the underside of the top portions 18 and aid in mounting the top portions on the base 12. It is seen that upon operation of the cylinder 34, the piston rod 32 reciprocates to move the transfer plate 27 in a corresponding motion for transferring drill blanks to a pick-up station, as will also be described. As further shown in FIG. 1, the belt 26 extends around a roller 40, the shaft of which is journalled for rotation in bearings 41 that are mounted on spaced brackets 42 fixed to the side wall 24 of the housing 12. The belt 26 further extends around an interiorly located roller 44 the shaft of which is journalled in bearings 45 mounted on spaced brackets 46 fixed to the interior of the side wall 24. A weight 48 is attached to the outermost end of the belt 26 and provides for controlled movement of the belt 26 during the transfer operation.

Figure 8:
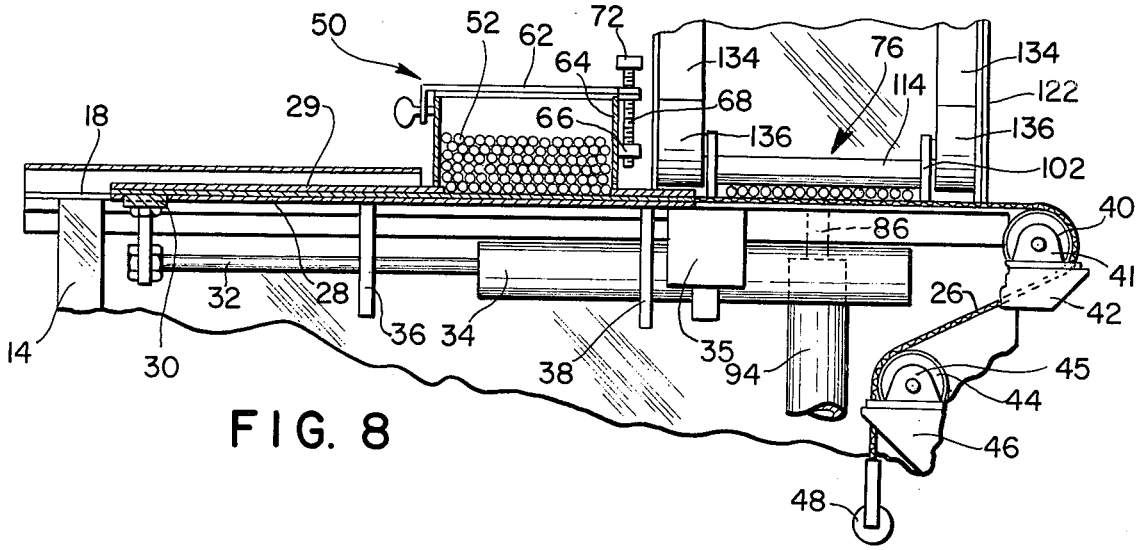
FIG. 8 is a sectional view of the transfer mechanism with the drive assembly thereof shown in elevation, the transfer plate being shown in a position prior to the transfer of the drill blanks to the pick-up station and corresponding to the position illustrated in FIG. 6.
Figure 9:
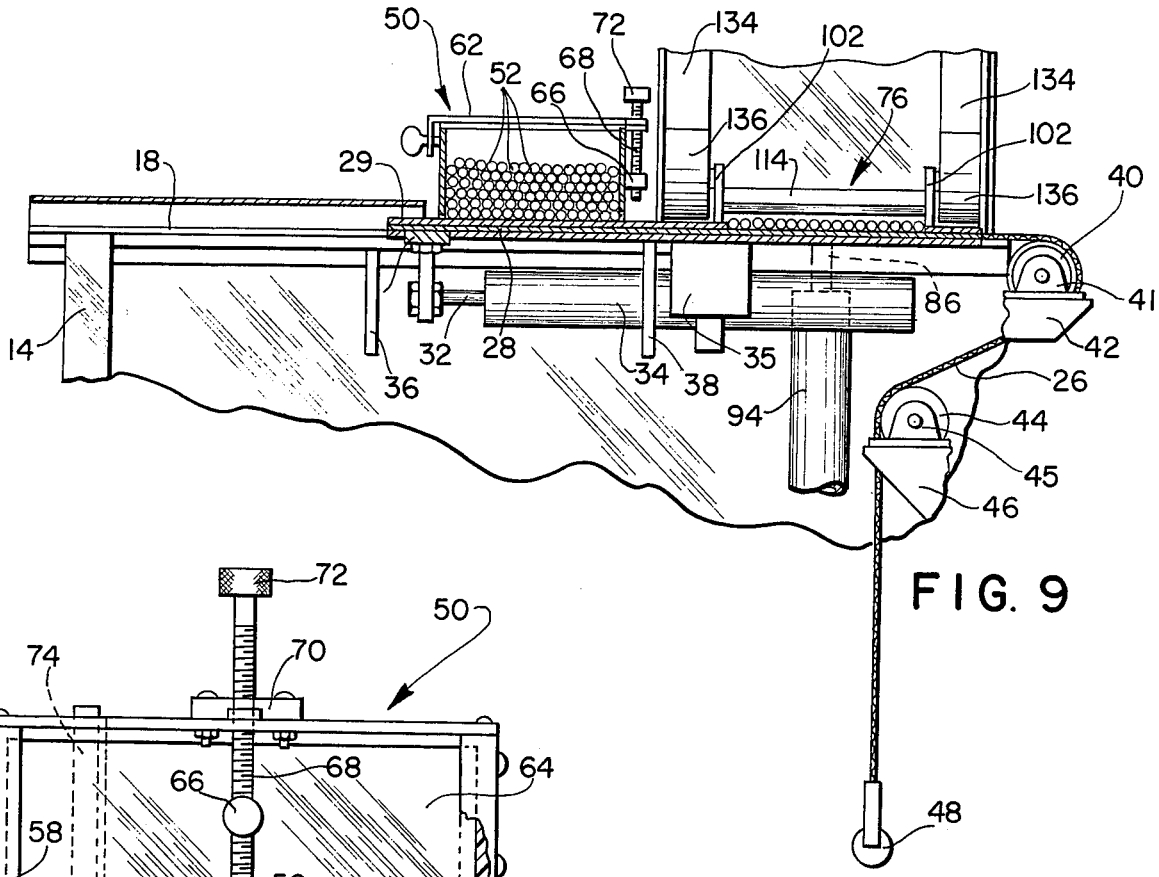
FIG. 9 is a view similar to FIG. 8 illustrating the location of the transfer mechanism after the drill blanks have been transferred to the pick-up station and corresponding to the position shown in FIG. 7.

Mounted on the top portions 18 of the base 12 is a magazine assembly generally indicated at 50 in which a plurality of drill blanks 52 to be heat treated are deposited. The magazine assembly 50 is mounted directly over the transfer plate 27, the transfer plate 27, in effect, defining the bottom wall of the assembly 50 and receiving the bottommost layer of the drill blanks 52 thereon. As shown in FIGS. 8 and 9, the plate 29 of the transfer plate 27 is cut away as indicated at 54, the cut away portion 54 cooperating with the plate 28 to define a cavity receiving a plurality of the drill blanks 52 therein when the cavity 54 is located beneath the magazine assembly 50. Upon movement of the transfer plate 27 by the piston rod 32 and the corresponding movement of the belt 26, the drill blanks as contained within the cavity 54 located beneath the magazine assembly 50 are transferred to a pick-up station generally indicated at 56 in FIG. 1. As will be described in the operation of the apparatus hereinafter, the drill blanks 52 as moved to the pick-up station 56 are moved into engagement with a jaw assembly for transfer to a heating chamber for the heat treatment thereof.

Figure 10:
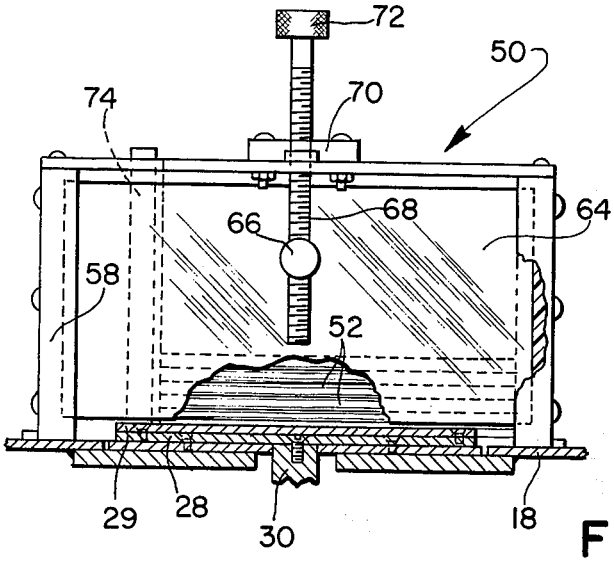
FIG. 10 is a front elevational view of the magazine for the drill blanks with parts cut away and shown in section.

As shown more clearly in FIG. 10, the magazine assembly 50 includes side walls 58 and a rear wall 60 (FIG. 1) over which a cover 62 is normally located. Adjustably mounted on the cover 62 and movable relative to the walls 58 and 60 is a front stripping plate 64. Joined to the stripping plate 64 of the magazine assembly 50 is a lug 66 that receives an adjustment screw 68 in fixed relation, the adjustment screw 68 extending through a bracket 70 mounted on the cover 62. As more clearly illustrated in FIG. 10, the adjustment screw 68 has an enlarged head portion 72 formed on the uppermost end thereof that provides for the adjustable positioning of the stripping plate 64. It is seen that the rotation of the screw 68 within the bracket 70 vertically moves the stripping plate 64 for positioning the lowermost edge thereof relative to the transfer plate 27, thereby providing for the movement of only the drills located in the cavity 54 of the transfer plate 27 out of the magazine assembly and to the pick-up station 56. The stripping plate 64 thus allows only the lowermost level of blanks as located in the cavity 54 to be moved to the pick-up station 56. As further illustrated in FIG. 10, an adjustment plate 74 is mounted within the magazine 50 for lateral movement relative to the side walls 58, and thus is adjusted to vary the interior lateral dimension of the magazine to accommodate various length drill blanks therein. Any suitable adjustment device is provided for moving the adjustment plates 74 in the manner as illustrated and described. It is seen that during each transfer operation, the drills 52 located at the bottommost end of the magazine 50 are received within the cavity 54 of the transfer plate 27. The position of the stripping plate 64 relative to the transfer plate 27 is preestablished to permit discharge of the drills 52 as located in the magazine assembly 50. Thus stripping plate 64 is arranged such that when the transfer plate 27 is moved by the piston rod 32, only a single layer of the drills 52 will be moved to the pick-up station 56.

Figure 12:
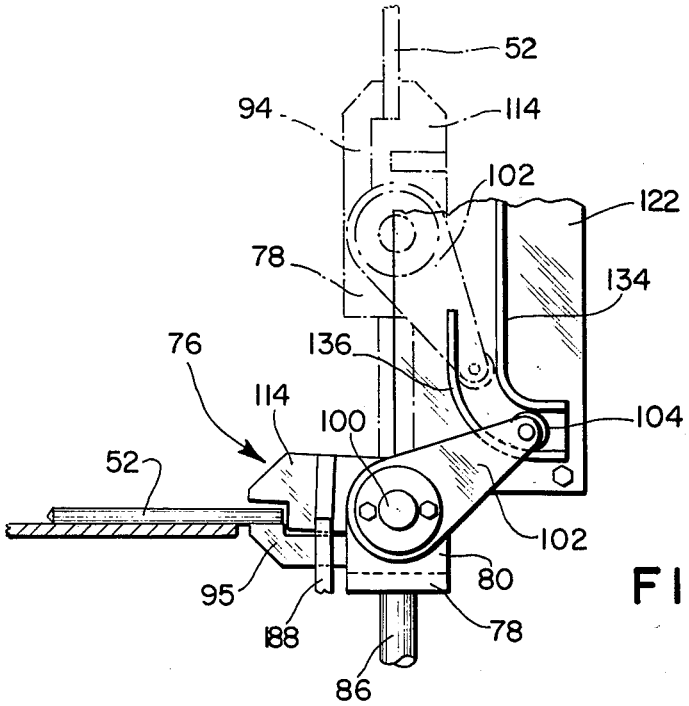
FIG. 12 is a side elevational view of the jaw assembly and a track member associated therewith that provides for movement of the jaw assembly from a generally horizontal to a vertical position during the elevation thereof to the heating chamber.

Referring now to FIGS. 1, 3, and 12, the jaw assembly generally indicated at 76 is illustrated, and as will be described, the jaw assembly 76 is locatable at the pick-up station 56 for receiving the drill blanks 52 transferred thereto by the transfer plate 27, whereafter the jaw assembly 76 is operable to transfer the drill blanks to the furnace heating chamber for the heat treatment thereof. The jaw assembly 76 as shown more clearly in FIGS. 14, 15, and 16, includes a base plate 78 to the extreme ends of which end flanges 80 are joined. Suitable openings 82 are formed in the end flanges 80 for receiving bearing rings 84 therein. Connected to the base plate 78 is a piston rod 86 that is threaded at the outer end 88 thereof, the threaded end 88 extending through an opening in the base plate 78 and being engaged by opposed nuts 90 and 92 for locking the piston rod 86 to the base plate 78. The piston rod 86 extends outwardly of a hydraulic cylinder 94, which as illustrated in FIG. 1 is vertically mounted within the base 12. The piston rod 86 projects upwardly of the cylinder 94 adjacent to the pick-up station 56, and is operable in predetermined timed relation to move the jaw assembly 76 in a vertical direction thereby carrying a plurality of drill blanks 52 upwardly to the furnace heating chamber for the heat treatment thereof.

Figure 14:
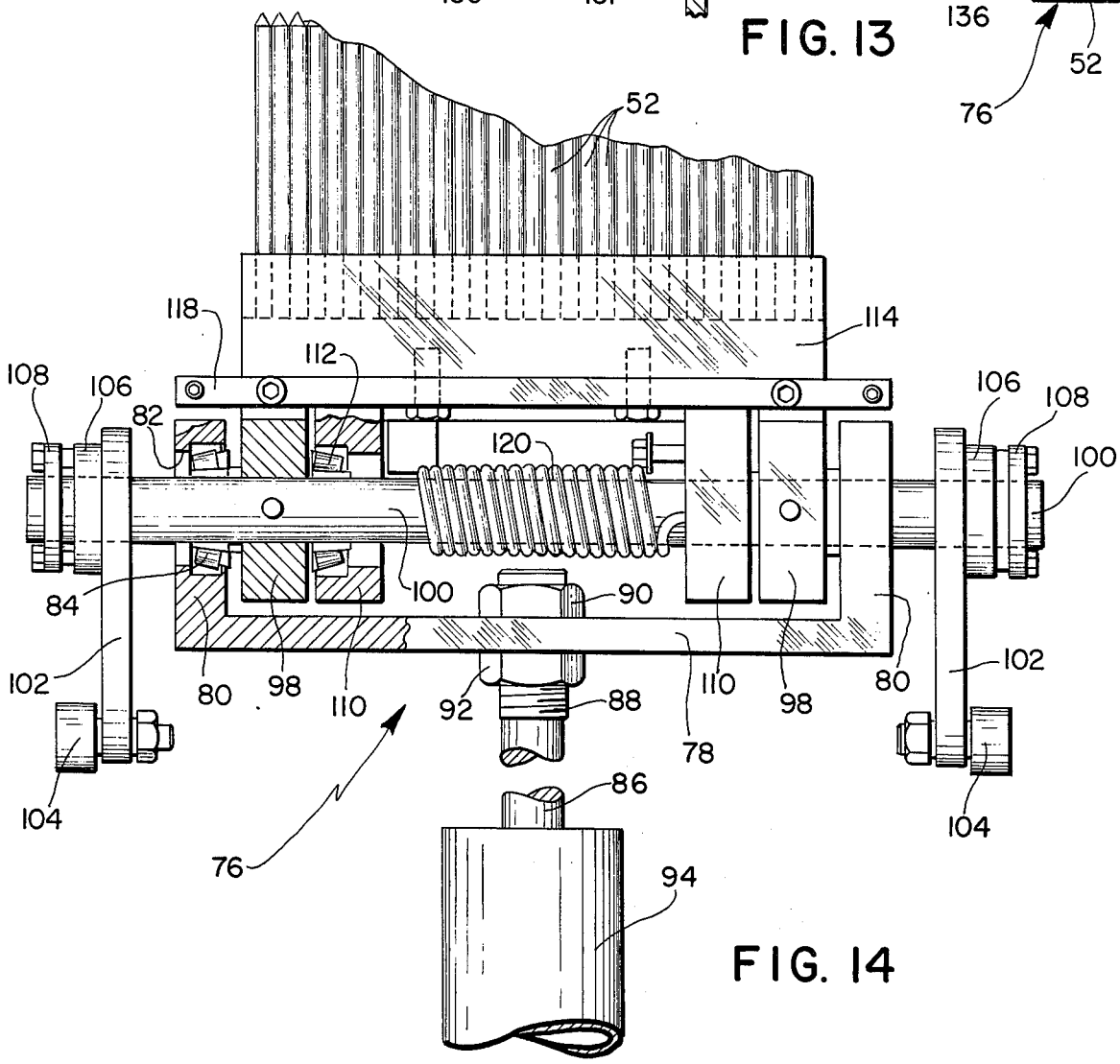
FIG. 14 is a horizontal sectional view with parts shown in elevation of the jaw assembly as it is located in the vertical position during transfer of the drill blanks to and from the heating chamber.
Figure 15:
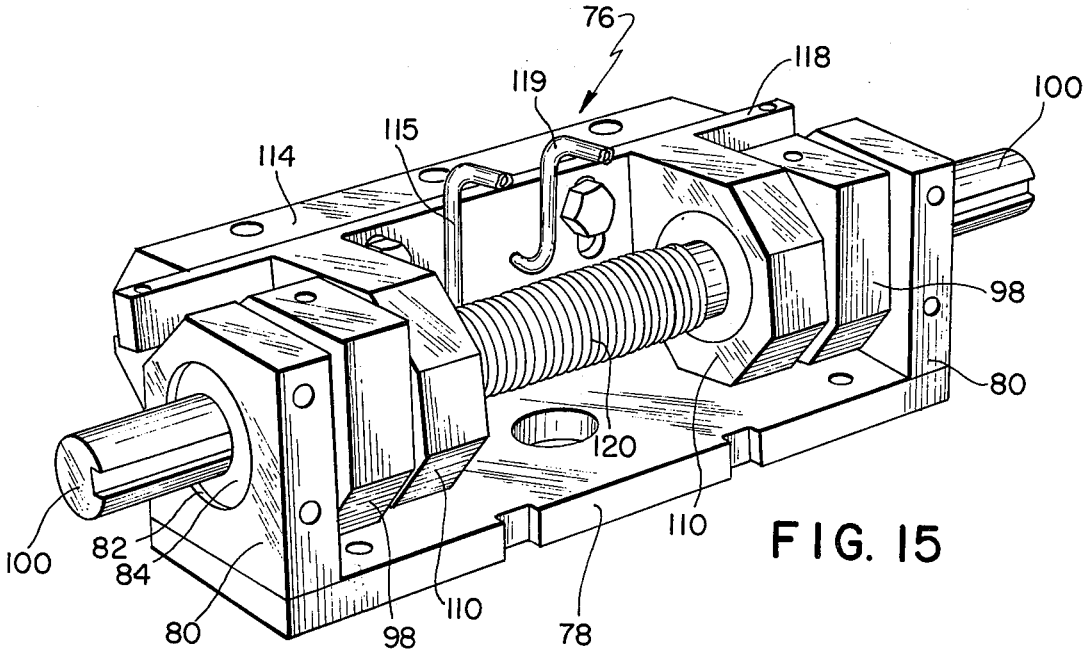
FIG. 15 is a rear perspective view of the jaw assembly.
Figure 16:
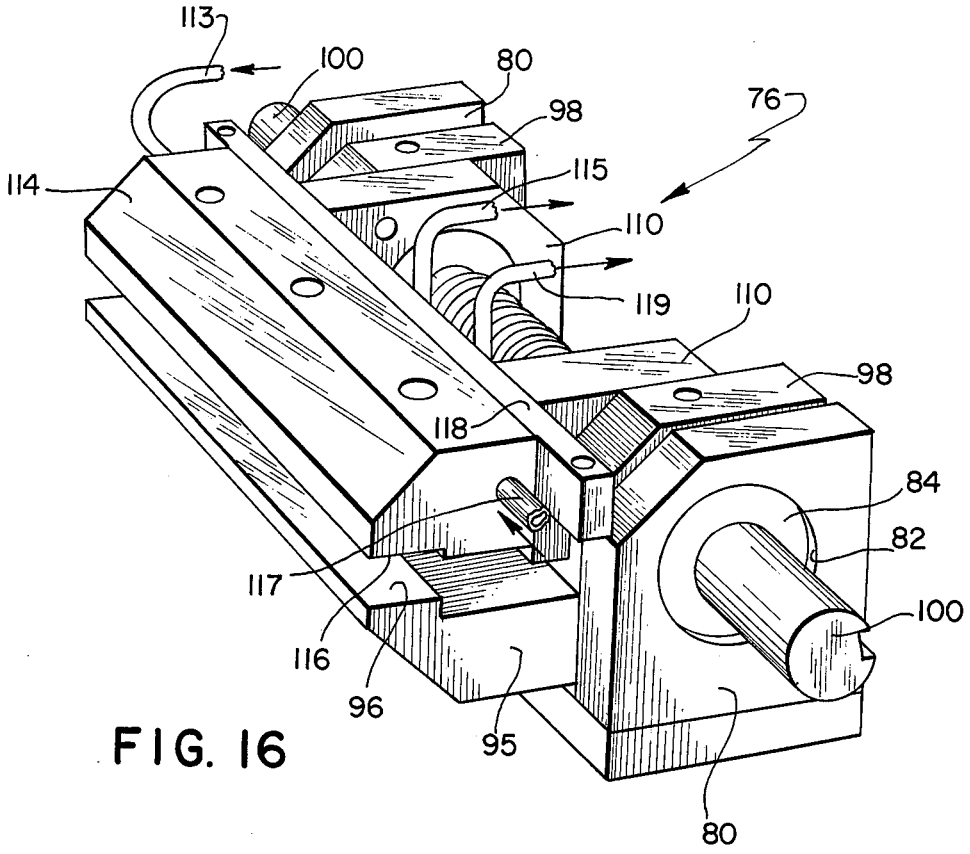
FIG. 16 is a front perspective view of the jaw assembly.

As further illustrated in FIGS. 14, 15, and 16, the jaw assembly 76 includes a fixed jaw 95 having a clamping surface 96 formed thereon. The fixed jaw 95 is joined to blocks 98 that are pinned to a shaft 100 received in the bearing rings 84 of the end flanges 80. Mounted on the outer ends of the shaft 100 are levers 102 to which roller followers 104 are fixed. Suitable washers 106 and lever hubs 108 are secured to the outer ends of the shaft 100 for locating the levers 102 in the appropriate position as illustrated in FIG. 14. As will be described, the roller followers 104 are received on spaced cam tracks and are movable thereon for effecting a prescribed movement of the jaw assembly 76 as it is transferred from the pick-up station 56 to the heating chamber of the furnace.

Mounted on the shaft 100 for rotation with respect thereto are bearing blocks 110 in which bearing rings 112 are located and through which the shaft 100 extends. The bearing blocks 110 are joined to a movable jaw 114 that is also formed with a bearing surface 116 as illustrated in FIG. 16. Projecting outwardly beyond the opposed ends of the jaw 114 are fingers 118, the purpose of which will be described hereinafter. Extending around the shaft 100 is a tension spring 120, one end of which engages a bearing block 110. The tension spring 120 normally urges the movable jaw 114 into positive engagement with the fixed jaw 94 wherein the bearing surfaces 96 and 116 are urged toward each other. Both jaws 95 and 114 are water cooled and for this purpose, an inlet pipe 113 directs a cooling fluid through a passage in the jaw 114 for discharge through an outlet pipe 117. An inlet pipe 115 directs cooling fluid into a passage formed in the jaw 95, discharge being through an outlet pipe 119. The cooling of the jaws 95 and 114 also provides an effective means for removing heat that is conducted to the shank portion of the blanks during the heat treating operation. Mounted on the top portions 18 of the base 14 are spaced side walls 122 that extend upwardly to form the lower end of a furnace housing generally indicated at 124. A shortened front wall 132 and a rear wall 134 cooperate with the side walls to form an enclosure for the lower end of the furnace housing 124. The furnace housing 124 also includes an upper shroud defined by side walls 126, a front wall 128 and a rear wall 130. A cover 132 (FIG. 3) is mounted on the front wall 128 and rear wall 130 and cooperates therewith to define the shroud that encloses the furnace heating chamber. As seen in FIG. 3, the shroud overlaps the lower end of the housing to define air inlet passages that provide for free circulation of air around the furnace heating chamber. Fixed to the interior surface of the side walls 122 of the lower furnace housing are tracks 134, the bottommost ends of which are curved rearwardly and that include second track portions 136 that cooperate with the tracks 134 to capture the roller followers 104 of the jaw assembly 76 therebetween for moving the jaw assembly to and from the horizontal and vertical positions in operation of the apparatus. It is seen that as the piston 86 elevates the jaw assembly 76 from the pick-up station 56 to the furnace heating chamber, the roller followers 104 engage the tracks 134 that maintain the jaw assembly 76 in aligned vertical relation at it ascends in its upward travel.

Figure 13:
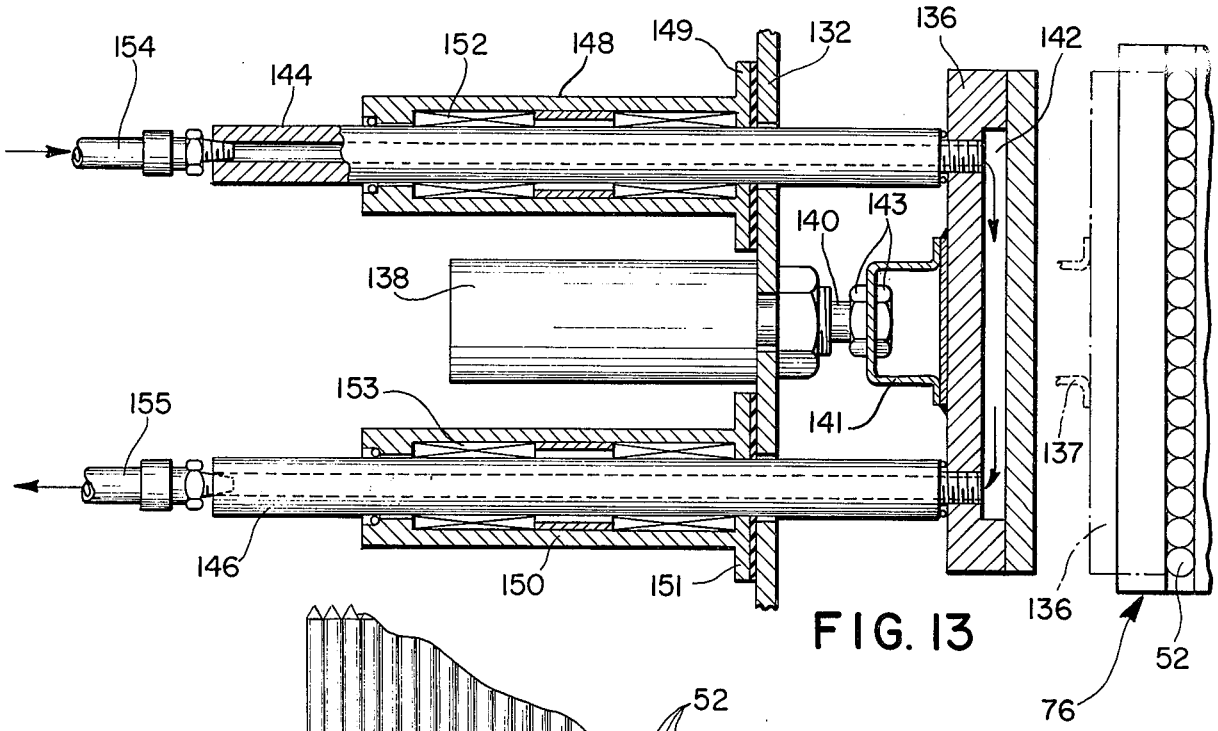
FIG. 13 is a sectional view of a quench block and the cooling assembly associated therewith.

As further illustrated in FIG. 3, a front wall 135 and a rear wall 137 of the lower furnace housing cooperate with the adjacent side walls 122 to define a cooling station therebetween generally indicated at 139. The cooling station 139 is located directly below the furnace chamber enclosed in the upper shroud, and positioned at the cooling station in spaced relation therein are quench blocks 136. As shown in FIG. 13 the quench blocks 136 are water cooled, and are movable in a linear horizontal direction toward each other for engagement with the heated fluted portions of the drill blanks after the blanks have been withdrawn from the heating chamber. In order to provide for the movement of the quench blocks 136 an air cylinder 138 is exteriorly mounted on each wall 135 and 137 and includes a piston rod 140 that is directly connected to a bracket 141 mounted on a quench block 136 by nuts 143. The quench blocks 136 are movable by the piston rods 140 toward each other for engagement with the fluted portions of the drill blanks that have been withdrawn from the furnace heating chamber, wherein the temperature thereof is reduced in a prescribed manner following the heat treatment operation. As illustrated more clearly in FIG. 13, each of the quench blocks 136 is water cooled and for this purpose is provided with an interior chamber 142 that communicates with a source of fluid such as water that is directed thereto through a tubular member 144. The cooling liquid circulates through the chamber 142 and is directed outwardly therefrom through a similar tubular member 146. The tubular members 144 and 146 are mounted in appropriate bearing blocks 148 and 150 having bearings 151, 153 respectively located therein, the bearing blocks 148, 150 being formed with flanges 149 and 151 respectively for mounting on the walls of the lower furnace housing. An inlet conduit 154 commiunicates with the interior of the tubular member 144 while an exit conduit 155 communicates with the interior of the tubular member 146. It is seen that each of the cylinders 138 in the operation thereof causes their respective piston rods 140 to move the bearing blocks 136 and the tubular members 148 and 150 therewith for engagement of the quench blocks 136 with the heat treated fluted portions of the drill blanks that have been withdrawn from the furnace heating chamber.

Figure 5:
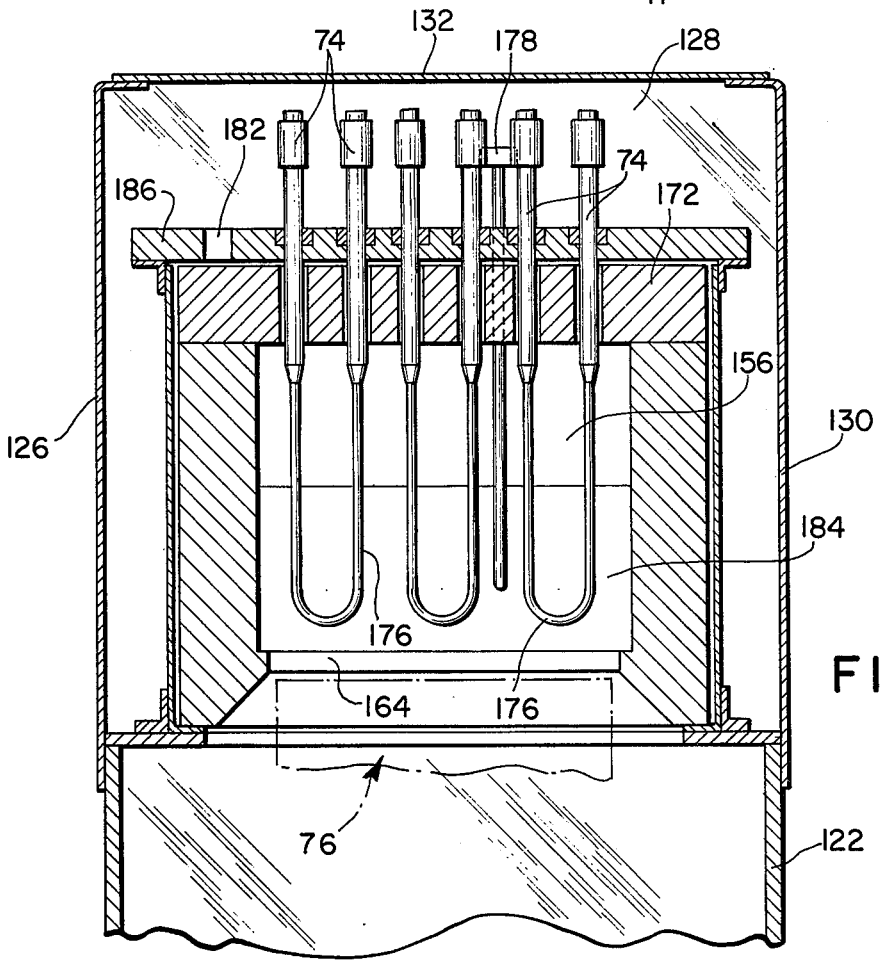
FIG. 5 is a sectional view of the heating chamber showing the location of the heating elements therein.
Figure 6:
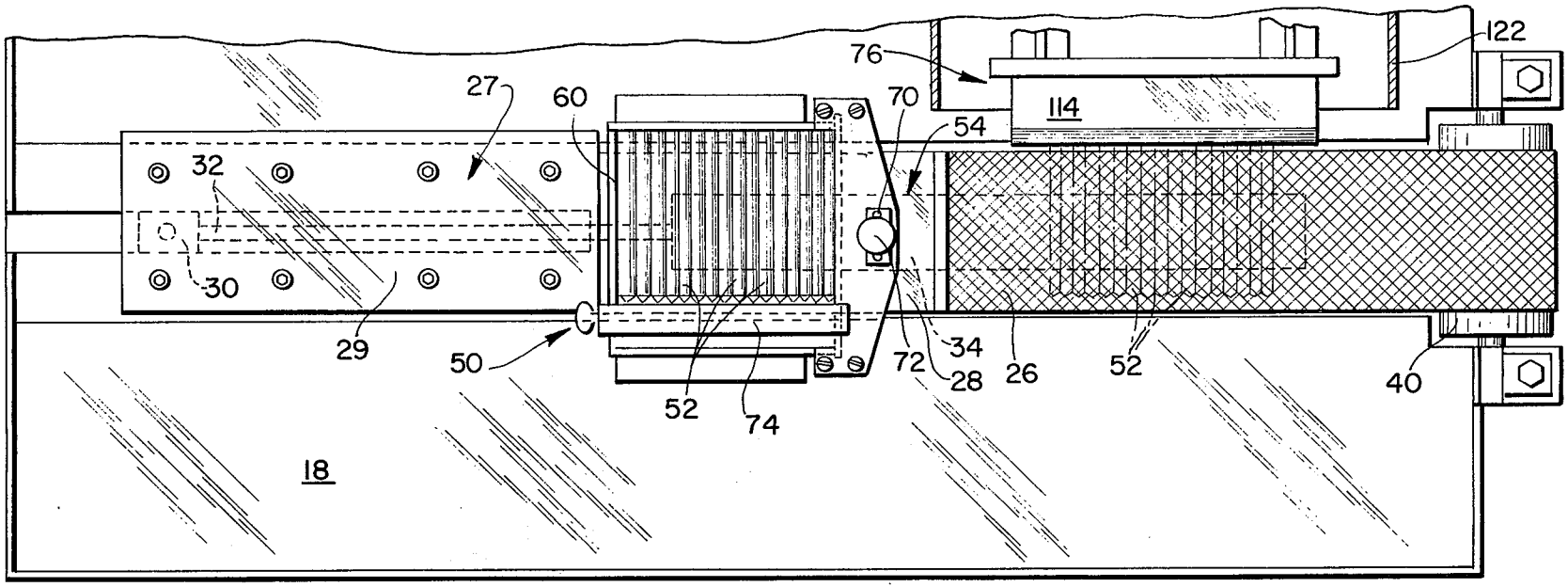
FIG. 6 is a top plan view of the apparatus with parts shown in section and illustrating the location of the transfer mechanism prior to the transfer of a plurality of drill blanks to the pick-up station.
Figure 7:
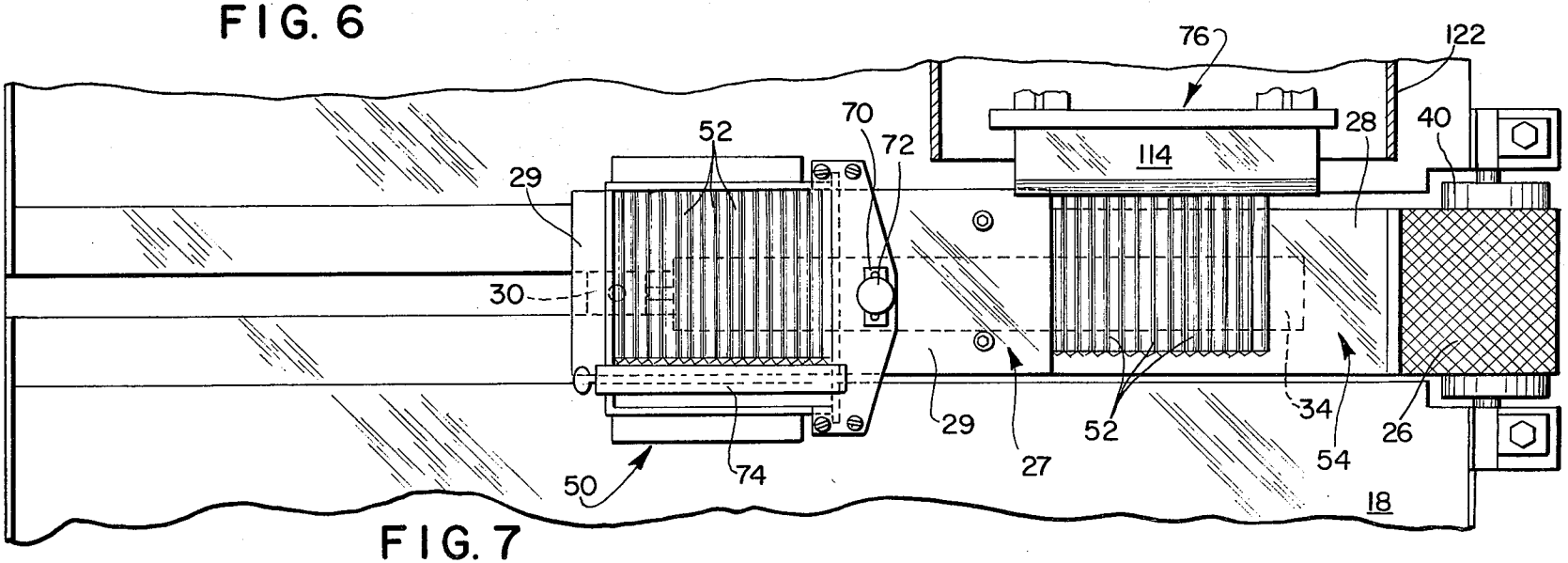
FIG. 7 is a view similar to FIG. 6 and illustrates the location of the transfer mechanism after the transfer of the drill blanks to the pick-up station.
Figure 11:
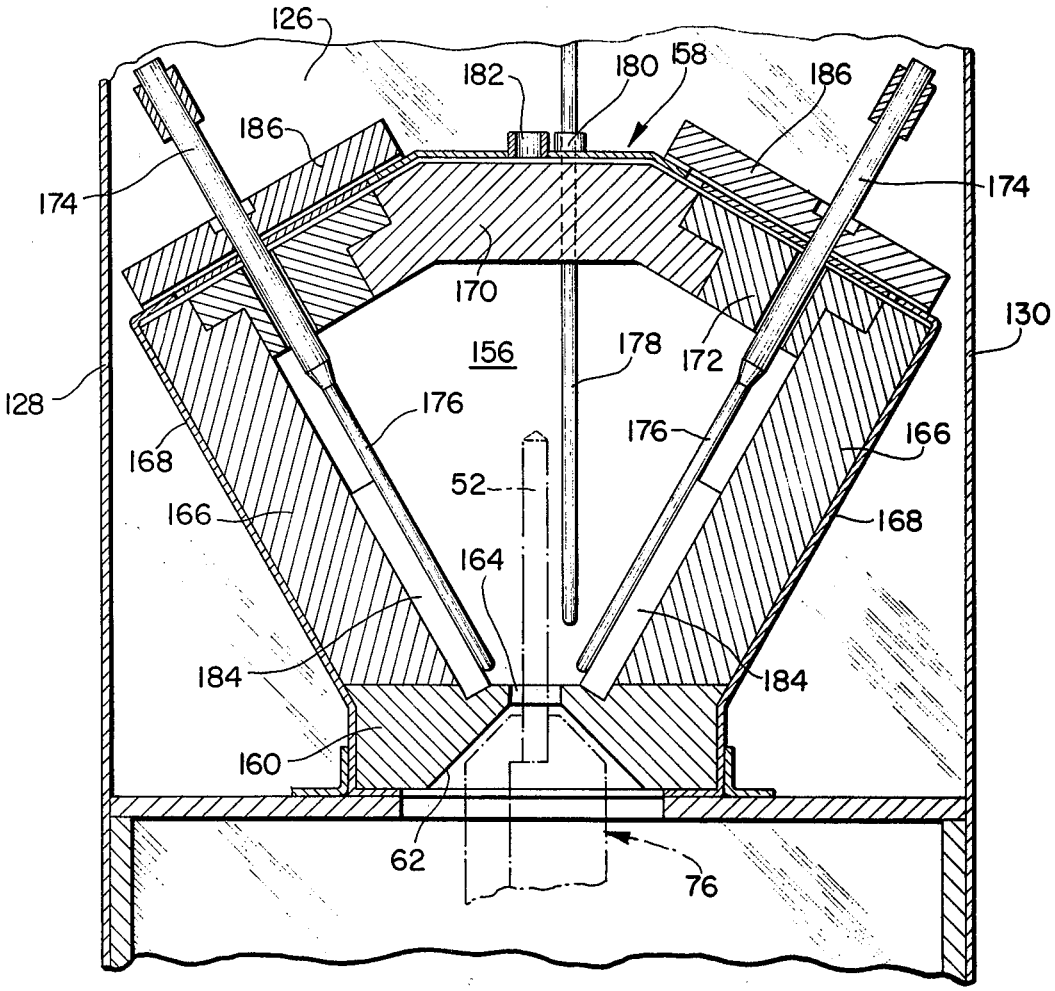
FIG. 11 is a sectional view of the heating chamber that is normal to the view illustrated in FIG. 5 and further illustrating the location of the heating elements therein.

As shown in FIGS. 3, 5, and 11, the furnace heating chamber, that is indicated at 156 is located within the shroud positioned above the quench blocks and is defined by insulating members that are constructed and arranged in a way to afford maximum heating ability for the heat treatment of the drill blanks. In this connection, the furnace, that is, generally indicated at 158 includes a base insulating block 160 in which a tapered recess 162 is formed on the underside thereof for receiving the uppermost portion of the jaw assembly 76. The recess 162 communicates with an opening 164 that receives the fluted portions of the drill blanks as they are moved upwardly into the interior of the furnace heating chamber 156 by the jaw assembly 76. Mounted on the base block 160 of the furnace 158 are inclined side blocks 166 that are encased by side walls 168, the side walls 168 also enclosing the base block 160. The uppermost wall of the furnace is defined by a top block 170 to which T-blocks 172 are interfitted therewith and the upper portions of the side blocks 166. Suitable openings are formed in the T-blocks 172 for receiving the uppermost ends 174 of the heating elements 176, the lowermost ends 174 of the heating elements are conveniently interconnected exteriorly of the furnace to a source of electrical energy that provides the necessary current for heating the heating element 176 to the required temperature.

The heating elements 176 are formed in a U-configuration, as shown more clearly in FIG. 5, and are inclined to the vertical as shown in FIG. 11, the angle as illustrated being approximately 30°, which angle is designed to provide temperature uniformity within the furnace heating chamber 156. A thermocouple 178 extends through a suitable port 180 in the top block 170 and controls the temperature of the furnace within a range of 1500° F to 2400° F. It is understood that the temperature within the heating chamber 156 is controlled to provide for effective heat treatment of the articles located therein in accordance with the materials from which the articles are formed. An additional port 182 is also formed in the block 170 and communicates with the interior of the furnace heating chamber for supplying a heat treating atmosphere therein, if such atmosphere is necessary. Also located within the heating chamber 156 and fixed to the side walls 166 are support pillows 184 that are formed of a material that is compatible with the heating elements that rest thereon. Upper packing blocks 186 are located on the exterior of the furnace 158 adjacent to the T-blocks 172 and are formed with suitable openings through which the heating elements 174 extend.

Operation

The drill blanks 52 to be heat treated are deposited in the magazine assembly 50, the shank portions of the drill blanks being oriented so that when they are moved to the pick-up station, they will be grasped between the jaws 95 and 114 of the jaw assembly 76, thereby exposing the fluted portions of the drill blanks. Generally, the drill blanks 52 are formed of high-speed steel and can range in size from $\frac{1}{8}$ to $\frac{1}{2}$ inch in diameter. The acceptable maximum length of the drill blanks as contemplated for heat treating by the present invention is 6 inches, although it is understood that the apparatus can be modified to accommodate longer length blanks and different tools other than drill blanks if it is so desired. With the magazine assembly 50 filled with the drill blanks 52 in oriented relation, the lowermost layer thereof is received in the cavity 54 as formed in the transfer plate 27. The front or stripping plate 64 of the magazine 50 is adjustably located by the adjustment screw 68 to permit only a single layer of the drill blanks 52 to be transferred by the transfer plate 27 to the pick-up station 56.

The operation of the apparatus 10 is automatic and continuous, the transfer of the blanks 52 to the pick-up station 56 and the successive steps in the heat treating of the drill blanks all being automatically carried out in accordance with the timing sequence of the equipment. With the machine set on automatic, the cycle is initiated by depressing a starting button, which causes the cylinder 34 to be operated for producing a longitudinal movement of the piston rod 32 and the transfer plate 27. As the cycle begins, the jaw assembly 76 is positioned at the pick-up station 56, with the jaws 95 and 114 located in the open position as illustrated in FIG. 16. In this position, the jaw 114 has been moved to the open position against the action of the spring 120 by engagement of the fingers 118 with bars 188 that are fixed to the base 12 (FIG. 12). As soon as the lowermost layer of the drill blanks 52 as disposed in the cavity 54 of the transfer plate 27 are moved between the jaws 95 and 114, thereby exposing the fluted portions of the blanks, the cylinder 94 is actuated to cause the piston rod 86 to move upwardly. As the piston rod 86 begins its upward travel, the spring 120 clamps the movable jaw 114 against the shanks of the drill blanks 52 as located between the jaws 95 and 114 to lock the drill blanks therebetween with the fluted portions of the blanks exposed. Continued upward travel of the piston rod 86 moves the jaw assembly 76 from the horizontal position as shown in full lines in FIG. 12 to the vertical position as shown in phantom lines therein, the movement of the follower rollers 104 between the track sections 134, 136 forcing the jaw assembly 76 to the vertical position. The piston 86 continues the upward travel thereof, thereby carrying the jaw assembly 76 and the drill blanks retained therein upwardly through the cooling station 139, the fluted portions of the drill blanks then being directed through the opening 164 of the furnace 158 for entry into the furnace heating chamber 156. The heating elements 176 as located in the heating chamber are heated to the required temperature, depending upon the material from which the drill blanks are formed, and the temperature is automatically controlled therein by the thermocouple 178. It is understood that the vertical transfer of the drill blanks maintains the blanks in a substantially straight position so as to avoid any distortion which normally would occur if the blanks were located in a horizontal position as fixed in a jaw assembly.

The heat treating cycle in the heating chamber depends upon the size of the blanks, blanks of $\frac{1}{8}$ inch size requiring approximately a three-minute heating cycle. Following the heating cycle, the cylinder 94 in timed relation is operated to retract the piston rod 86 and the jaw assembly 76 fixed thereto, thereby withdrawing the drill blanks 52 from the heating chamber 156. The jaw assembly 76 is then moved into the cooling station 139, at which the heat treated drill blanks are disposed between the quench blocks 136, as illustrated in FIGS. 3 and 13. With the blanks located between the quench blocks 136, the cylinders 138 are automatically actuated to move the quench blocks 136 in a longitudinal direction for engagement thereof with the exposed heat treated portions of the drill blanks. The cooling cycle is limited, depending upon the size of the drill blanks, the $\frac{1}{8}$ inch drill size requiring approximately a thirty second quench interval. Thereafter, cylinder 94 is again activated and the piston rod 86 continues its downward travel for transferring the jaw assembly 76 and the drill blanks retained therein to the pick-up station 56. As the follower rollers 104 of the jaw assembly 76 are moved between the track portions 134 and 136, the curvature thereof again forces the jaw assembly from the verticle position as shown in phantom in FIG. 12 to the horizontal position thereof as shown in full lines. Once again the fingers 118 strike the bars 188 to open the jaw 114, thereby releasing contact of the jaws 95 and 114 on the shank portions of the drill blanks. At this point, the drill blanks 52 are deposited on the belt 26, which is then sequentially actuated to move the treated blanks away from the pick-up station to a collection area. Simultaneously, with the removal of the treated blanks, the movement of the belt 26 produces a corresponding movement of the transfer plate 27, which then transfers the next batch of drill blanks to the pick-up station and between the jaws 95 and 114 of the jaw assembly.

It is seen that the apparatus by which the drill blanks are processed causes the exposed fluted portions of the blanks to be bright-hardened following the cooling cycle, while the shank portions thereof are maintained relatively soft for a better gripping action in use and for later stamping the drill size or other identifying indicia thereon. As described hereinabove, the shank portions are maintained in the relatively soft condition by introducing only the fluted portions of the drill blanks into the heating chamber as the jaw assembly 76 moves upwardly for the heating cycle. In this connection the shank portions may be additionally protected by inerting a heat resistant rope or the like between the jaws to insulate the shanks from heat that is conducted through the jaws during the heat treating operation. Thus, the shank portions of the drill blanks are assured of only being partially heated to the austenitizing temperature; and when the blanks are moved into the cooling station 139, the heat is removed therefrom quickly enough to prevent the shanks of the drill blanks from reaching the hardening temperature. The cooling of the jaws also acts to remove heat conducted thereto during the heat treating operation and aids in preventing the blanks for reaching the hardening temperature. Since the shanks of the drills as removed from the collection station of the apparatus are relatively soft, stamping thereon may be conveniently carried out without any additional procedures required. Although not illustrated or described herein, the electrical, pneumatic and hydraulic systems for operating the cylinders 34, 94, and 138 are conventional and are automatically controlled through conventionally positioned limit switches, timers and the like.

Although the present invention has been described in connection with the heat treatment of metallic articles such as drill blanks, it is understood that other metallic articles can be heat treated in a similar manner, particularly when it is desired to maintain a portion of the articles in a relatively soft condition for a marking or other heating operation.

While there is shown and described herein certain specific structure embodying the invention, it will be manifest to those skilled in the art that various modifications of the parts may be made without departing from the spirit and scope of the underlying inventive concept and that the same is not limited to the particular forms herein shown and described except insofar as indicated by the scope of the appended claims.

What is claimed is:

1. Apparatus for automatically heat treating a plurality of elongated articles, wherein each of said articles includes a first portion and a second portion, comprising a base, a feeding assembly mounted on said base and including means for feeding a predetermined number of said articles to a pick-up station located on said base, a furnace housing mounted on said base in spaced relation with respect to said pick-up station and having a heating chamber and a cooling station located in spaced vertical relation therein, said cooling station being spaced above said pick-up station in vertical alignment therewith, and said heating chamber being spaced above said cooling station in vertical alignment therewith and said pick-up station, and a transfer mechanism mounted on said base and including a jaw assembly for receiving the first portion of a plurality of said articles therein at said pick-up station and a lift device for moving said jaw assembly and the articles retained therebetween from said pick-up station through said cooling station and to said heating chamber, wherein only the second portion of said articles are exposed for the heat treatment thereof, said lift device thereafter moving said articles to said cooling station for a preselected interval for the cooling thereof, whereafter the treated articles are returned to the pick-up station for removal therefrom to a collection station.

2. Apparatus as claimed in claim 1, said feeding means including a magazine assembly in which said articles are received, a transfer plate extending below the bottom of said magazine assembly and having an article receiving area in which a predetermined number of said articles are located, and means connectable to said plate for periodically moving said plate in a direction toward said pick-up station and into a position for locating the articles in engagement with said jaw assembly.

3. Apparatus as claimed in claim 2, said magazine assembly including a forward plate, and means for adjusting the vertical position of said forward plate relative to said transfer plate to compensate for different size articles that are receivable in said magazine assembly for transfer to said jaw assembly.

4. Apparatus as claimed in claim 3, said moving means including a flexible belt to which said transfer plate is connected, and a fluid operated motor interconnected to said flexible belt for moving said belt and the transfer plate connected thereto in a linear direction at predetermined intervals to transfer said articles from said magazine assembly to said jaw assembly.

5. Apparatus as claimed in claim 2, said jaw assembly having a fixed jaw and a movable jaw and a spring for normally locating said movable jaw in a closed position relative to said fixed jaw for clamping the first portion of said articles therebetween, cam tracks mounted in said furnace housing and having end portions that terminate adjacent to said pick-up station, followers interconnected to said movable jaw and engageable with said cam tracks, wherein said followers are responsive to engagement thereof with said cam tracks to move said movable jaw to an open position against the action of said spring when said jaw assembly is located at said pick-up station.

6. Apparatus as claimed in claim 5, a plurality of heating elements located in said heating chamber for heating said heating chamber to a predetermined temperature, said heating elements being arranged in rows that are inclined to the vertical to define a heating zone therebetween that provides temperature uniformity in the areas where the articles being heat treated are located.

7. Apparatus as claimed in claim 6, said heating elements being inclined at an angle of approximately 30° to the vertical.

8. Apparatus as claimed in claim 1, said lift device including a vertical ram having a piston that is interconnected to said jaw assembly and that is movable at predetermined intervals to elevate the jaw assembly and articles clamped therein from said pick-up station, through said cooling station and into said furnace heating chamber, said ram being operable to move said jaw assembly and articles downwardly to said cooling station and thereafter to said pick-up station after completion of said heating cycle.

9. Apparatus as claimed in claim 1, said cooling station including opposed quench blocks that are horizontally movable into engagement with said articles following removal of the articles from the heating chamber for cooling the articles to a predetermined temperature.

10. Apparatus as claimed in claim 9, said quench blocks being positioned between said heating chamber and said pick-up station, and means interconnected to said quench blocks and disposed in a generally horizontal position for moving said quench blocks in a linear horizontal motion in timed sequence for engaging said articles at said cooling station.

11. Apparatus as claimed in claim 1, spaced tracks located adjacent to said pick-up station and extending vertically thereabove, and followers mounted on said jaw assembly and engaging said tracks, the lower portion of said tracks having a configuration that directs said jaw assembly in a direction that moves said articles from a horizontal position at the pick-up station to a vertical position as said jaw assembly and articles clamped therein are transferred to said heating chamber.

12. Apparatus as claimed in claim 11, said furnace housing including spaced vertically extending side walls joined to said base end defining the pick-up station therebetween, said tracks being defined by opposed track members each of which is mounted interiorly of a side wall and that is curved at the bottommost end thereof, wherein said jaw assembly is moved from the horizontal to vertical position as the followers joined thereto follow the curved configuration of said track members.

13. Apparatus as claimed in claim 1, said feeding assembly further including a horizontally extending belt that is interconnected to said feeding means, said belt extending through said pick-up station and being operative to direct treated articles deposited thereon by said jaw assembly to said collection station.

14. Apparatus as claimed in claim 13, said belt including a free end, a weight attached to the free end of said belt and counterbalancing the belt as it is moved by said feeding means during the feeding operation of said articles to said pick-up station and upon retracting movement of said belt following the feeding operation.

15. Apparatus as claimed in claim 13, said feeding means further including a magazine assembly in which said articles are received, a transfer plate located below said magazine assembly and forming the bottom thereof, a cavity formed in said transfer plate for receiving a predetermined number of articles therein, wherein said feeding assembly is operable to periodically move the articles as located in said cavity to said pick-up station.

16. Apparatus as claimed in claim 15, said magazine assembly including a front wall that is vertically adjustable to define a stripping plate that permits only the articles located in the cavity in said transfer plate to move to said pick-up station.

17. Apparatus as claimed in claim 16, an adjustment plate located in said magazine assembly and being laterally adjustable to adjust the interior lateral spacing in said magazine assembly for accommodating articles of predetermined size therein.

18. Apparatus as claimed in claim 1, said articles being drill blanks, the first portion defining a shank thereof and the second portion defining the fluted portion thereof.

19. Apparatus as claimed in claim 1, said jaw assembly including a fixed jaw and a movable jaw, and spring means for normally urging said movable jaw to a closed position relative to said fixed jaw, and means located adjacent to said pick-up station and being engageable by said jaw assembly for moving said jaw assembly to an article pick-up position at said pick-up station, wherein said jaws are substantially horizontal and the movable jaw is spaced from the fixed jaw to define the open position thereof.

20. Apparatus as claimed in claim 19, said moving means including follower elements mounted on said jaw assembly, and track members located adjacent to said pick-up station and receiving said follower elements in engagement therewith, said track members having a configuration that forces said follower elements to move said jaw assembly to the position that locates the jaws substantially horizontal as said jaw assembly is moved downwardly from the heating chamber and cooling station by said lift device.

21. Apparatus as claimed in claim 19, each of said jaws having passages formed therein through which a cooling fluid is continuously circulated, said cooling fluid acting to effectively cool the jaws during the heat treating operation and to remove heat from the first portion of the articles conducted thereto during the heat treating operation.

* * * * *